United States Patent [19]

Konishi et al.

[11] 4,055,043

[45] Oct. 25, 1977

[54] MANIFOLD REACTOR

[75] Inventors: Masami Konishi; Kazumasa Futamura, both of Toyota, Japan

[73] Assignee: Toyota Jidosha Kogyo Kabushiki Kaisha, Toyota, Japan

[21] Appl. No.: 677,376

[22] Filed: Apr. 15, 1976

[30] Foreign Application Priority Data

Nov. 11, 1975 Japan ..... 50-134708
Nov. 11, 1975 Japan ..... 50-134709

[51] Int. Cl.[2] ..... F01N 3/10

[52] U.S. Cl. ..... 60/282; 60/322; 60/323

[58] Field of Search ..... 60/282, 322, 323

[56] References Cited

U.S. PATENT DOCUMENTS

| | | | |
|---|---|---|---|
| 3,722,221 | 3/1973 | Chopin | 60/322 |
| 3,775,979 | 12/1973 | Scheitlin | 60/282 |
| 3,799,196 | 3/1974 | Scheitlin | 60/323 |

*Primary Examiner*—Douglas Hart
*Attorney, Agent, or Firm*—Finnegan, Henderson, Farabow & Garrett

[57] ABSTRACT

In a manifold reactor for an internal combustion engine, the reactor including an inner core and an outer core of elongated cylindrical form, the inner core having open, opposite ends and being concentrically placed within the outer core in spaced relation from the walls of the outer core both in the radial direction and in the axial direction; exhaust gas intake pipes extending from engine cylinders through the walls of the outer and inner cores so as to open within the inner core; and at least one exhaust-gas-discharge pipe, having one end open to an annular space defined between the wall of the outer core and the wall of the inner core, the inner core is split in the axial direction into at least two cylindrical parts which are slidingly connected to each other in air-tight relation, each part being independently secured by welding to the inner surface of the cylindrical wall of the outer core by means of supporting members.

The supporting members may be formed from individual bands or by contours in the wall of the outer core. The bands, when utilized, have a central portion secured to the inner core by weld beads and preferably have cut-out areas in the sides adjoining the ends of the weld beads for avoiding thermal stress concentration at these locations.

8 Claims, 7 Drawing Figures

MANIFOLD REACTOR

BACKGROUND OF THE INVENTION

1. Field of the Invention

This invention relates to a manifold reactor for an internal combustion engine, and more particularly to improvements in an inner core and supporting members therefor so as to minimize the thermal stress created therein.

2. Description of the Prior Art

A manifold reactor is well known in an exhaust system for the purposes of converting or purifying exhaust gases from an internal combustion engine and includes an inner core and an outer core. It has been a common practice that the inner core is secured by welding to the outer core through means of supporting members. With such an arrangement, the interior of the inner core serves as a re-combustion chamber.

For achieving improved conversion, exhaust gases should be maintained at a high temperature and the size of the recombustion chamber should be increased so as to extend the dwelling time of the streams of exhaust gases through the re-combustion chamber. This, however, poses another problem in that the inner core, having considerable weight, has to be supported by inner-core supporting members, thereby limiting an increase in size of the re-combustion chamber from the viewpoint of strength of the construction.

On the other hand, the loads borne by the individual innercore supports may possibly be reduced by increasing the number of the supports. However, this only meets with partial success, since thermal expansion of the inner core, which is restricted by such an increased number of inner core supports, creates excessive thermal stresses in the supports. This, in turn, causes the failure or cracking in weld joints interconnecting the inner core and the inner-core supports or the outer core and the inner-core supports. Such failure and cracking then cause a reduction in the output of an engine or creates unwanted noises, and may even cause peeling and scattering of insulating materials within the manifold reactor, thus eventually neutralizing the functions of the manifold reactor completely.

More particularly, the inner-core support usually assumes a band form having a given length, its central portion being welded to the inner core and its end or leg portions being suitably bent and welded to the inner surface of the peripheral wall of the outer core according to a fillet-welding or a plug-welding technique. The inner-core supports are arranged in pairs in symmetric relation with respect to the inner core, as viewed in its cross section. In this respect, the inner-core support is placed crosswise of the inner core.

The strength of a fillet-welded joint interconnecting the inner-core support and the outer periphery of the inner core is not uniform, because of the irregular shapes of the opposite ends of the weld beads, so that stress concentration tends to take place at such ends. In addition, the ends of a weld bead and their heat-affected zones are likely to cause cracking due to thermal stresses which are created at the time of welding or due to a repeated cycle of heating and cooling of the manifold reactor, as experienced in service. As is well known, cracking thus caused will be the source of stress concentration. Cracking often takes place in the craters at the ends of a weld bead.

The weld beads interconnecting the inner core and the innercore support, according the prior art, therefore, cause defects such as cracking, as do the thermal stresses by being exposed to high temperature exhaust gases in service, with the result of separation of the inner-core support from the inner core.

It is accordingly desired to avoid the results of weld defects and the accompanying stress concentration due to thermal stresses caused by thermal expansion of the inner core and due to the repeated cyle of heating and cooling of the manifold reactor in service.

SUMMARY OF THE INVENTION

It is accordingly a principal object of the present invention to provide a manifold reactor which is of a moderate size and hence light in weight, yet achieving its intended functions.

It is another object of the present invention to provide a manifold reactor of the type described, which avoids the effect of thermal stresses due to thermal expansion of the inner core on the inner-core supporting members, i.e., cracking at the opposite ends of the weld bead or beads interconnecting the two.

It is a further object of the present invention to provide a manifold reactor, whose construction provides improved strength.

It is a yet further object of the present invention to provide a manifold reactor of the type described, which avoids stress concentration imposed on weld beads interconnecting the inner core and the inner-core supports.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the improvement in manifold reactors utilizing an inner core and an outer core of an elongated cylindrical form, the inner core having open, opposite ends and being concentrically placed within the outer core in spaced relation from the walls of the outer core both in the radial direction and in the axial direction; exhaust-gas intake pipes extending from engine cyclinders through the walls of the outer and inner cores so as to open within the inner core; and at least one exhaust-gas discharge pipe having one end open to an annular space defined between the wall of the outer core and the wall of the inner core, comprises at least two axially aligned cylindrical parts constituting the inner core, the parts having overlapping contiguous ends forming air-tight sliding connections between adjoining parts, and supporting members symmetrically spaced about the cylindrical parts of the inner core for independently securing each of the cylindrical parts of the inner core to the inner surface of the outer core.

Preferably, the supporting members are arranged in pairs, the supporting members of said pairs being on opposite sides of the individual cylindrical part.

Also, preferably, the inner-core supporting members are an integral part of the wall of the outer core being formed as a projection on the outer core wall having a rectangular longitudinal cross section, one side of the projection being in contact with the outer wall of the inner core and having an aperture therein for plug-welding the projection to the inner core.

Alternatively, the inner-core supporting members may be in band form, each having a central portion and end portions, the individual portions being bent, as required, to the contours of the inner core and outer core, the central portion being fillet-welded to the outer surface of the inner core and the end portions being plug-welded to the inner surface of the wall of the outer core.

When the band form of the inner-core supporting members is used, it is preferred that the supporting members have cut-out areas positioned in their longitudinal side edges adjacent to the opposite ends of weld beads interconnecting the inner core and inner-core supporting members so as to avoid stress concentration at these positions.

BRIEF DESCRIPTION OF THE DRAWINGS

The accompanying drawings, which are incorporated in and constitute a part of this specification, illustrate one embodiment of the invention and, together with the description, serve to explain the principles of the invention.

Of the Drawings.

DESCRIPTION OF THE PREFERRED EMBODIMENTS

Figure 1:
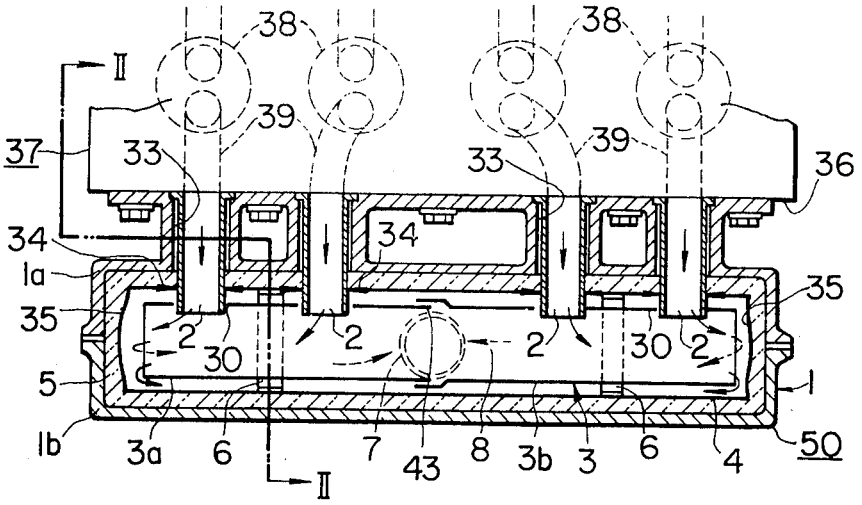
FIG. 1 is a longitudinal cross-sectional view of one embodiment of a manifold reactor according to the present invention.
Figure 2:
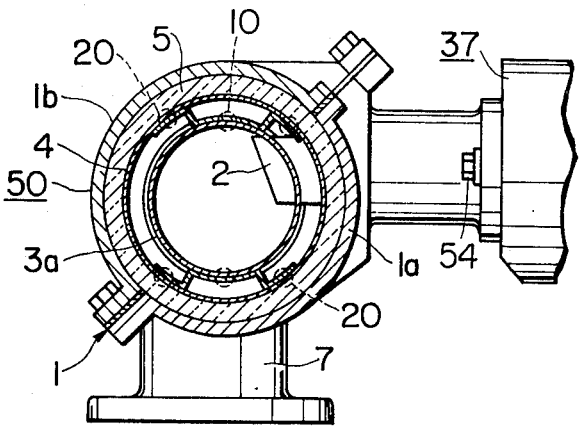
FIG. 2 is a transverse cross-sectional view taken along the line II—II of FIG. 1.

Referring to FIGS. 1 and 2, there is shown a manifold reactor 50 having an inner core 3 and an outer core 4, the cores being concentric. Exhaust pipes communicating with exhaust ports 39 in the respective cylinders 38 of an internal combustion engine 37 have exit passages, i.e., inlet passages 2 for the inner core, which passages extend through a case portion 1*a* and the wall of the outer core 4, and then through openings 30 in the inner core 3 therein.

In accordance with the invention, the inner core is an elongated cylinder which is split into at least two cylindrical parts, the opposite ends of the inner core being open.

As embodied herein, the cylindrical parts 3*a*, 3*b* of the inner core 3 are secured to the inner surface of the peripheral wall of the outer core 4 by means of inner-core supporting members 6. The supporting members 6 are positioned substantially in the central portions of the cylindrical parts 3*a*, 3*b* of the inner core, respectively, in symmetric relation with respect to the inner core, as viewed in its transverse cross section, as best shown in FIG. 2. The central portion of the inner-core supporting member 6 is fillet-welded at 10 to the outer peripheral surface of the inner core, while the opposite end portions of the inner-core supporting member are bent and plug-welded at 20 to the inner surface of the peripheral wall of the outer core 4.

As embodied herein, the inner core, constituted by the cylindridal parts 3*a*, 3*b*, is radially spaced from the inner surface of the peripheral wall of the outer core 4, with the opposite ends of the inner core spaced a distance from the inner surface 5 of the end walls 35 of the outer core. In other words, the inner core 3 is positioned within outer core 4 in concentric relation thereto.

In accordance with the invention, the cylindrical part 3*a* of the inner core has an end portion 43 of an increased diameter, which is adapted to be fitted on one end of the cylindrical part 3*b* in air-tight but sliding relation. Thus, in case the inner core undergoes thermal expansion, such thermal expansion is interrupted by the sliding joint between the cylindrical parts 3*a*, 3*b* so that the inner-core supporting member for the cylindrical part 3*a* will not be affected by the thermal expansion of another cylindrical part 3*b*, and vice versa. The cylindrical parts 3*a*, 3*b* of the inner core constitute a re-combustion chamber 8 in combination.

As embodied herein, the outer core 4 has opposite ends which are closed with plates 35 and an opening communicating with an exhaust-gas discharge pipe 7 in its center portion. Extending through the case portion 1*a* and then through the wall of the outer core 4 and into the inner cores 3*a*, 3*b* are heat insulating sleeves 34. In this respect, the heat insulating sleeves 34 are slidingly fitted in the wall of the outer core 4, and thus free to thermally expands.

The inner core 3 and the outer core 4 are enclosed in a cylindrical casing which may be divided into case portions 1*a*, 1*b* and has an opening 33, through which the inlet passage 2 defined by the heat insulating sleeve 34 extends into the inner core. Between the outer core 4 and the case portions 1*a*, 1*b* is a layer of heat-insulating material 49. The case portions 1*a*, 1*b* of the outer casing are secured together by any convenient means such as bolts 53, and the outer casing is secured to a cylinder head 36 of the engine 37 by means of bolts 54.

In operation, exhaust gases are introduced through the inlet passage 2 into the inner core, i.e., the re-combustion chamber 8, then out from the open, opposite ends of the cylindrical parts 3*a*, 3*b* of the inner core 3, then through the annular spacing 40 defined between the inner core and the outer core 4, then through the opening provided in the midpoint of the outer core into the exhaust-gas discharge pipe 7, as shown by arrows in FIG. 1. As a result, there may be obtained sufficient dwelling time of the streams of exhaust gases within a manifold reactor 50, with the resulting desired re-combustion at a high temperature.

Figure 3:
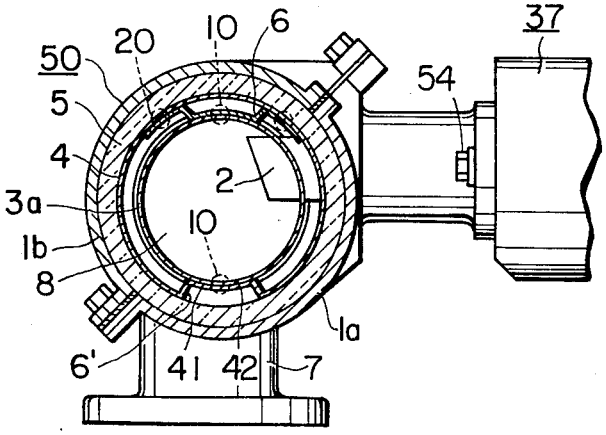
FIG. 3 is a transverse cross-sectional view similar to that shown in FIG. 2, of another embodiment of the manifold reactor according to the present invention.

In accordance with the invention, FIG. 3 shows another embodiment of the manifold reactor 50 which is similar to the embodiment of FIG. 2, except that the band form of one of the inner-core supporting members 6 of each of the symmetrical pairs of the embodiment of FIG. 2 has been replaced by a contour of a portion of the wall of the outer core 4. In the embodiment of FIG. 3, a box-shaped portion 6', having a rectangular longitudinal cross section is formed in the wall of the outer core 4 contacting the inner core 3. The box-shaped portion 6' has an opening 42 in its bottom 41, contacting the inner core 3 for welding the outer core 4 to the inner core by the plug-welding technique. The provision of the box-shaped portion 6' of the outer core 4 provides improved rigidity or strength, because of its shape, for the construction of the manifold reactor 50.

Figure 4:
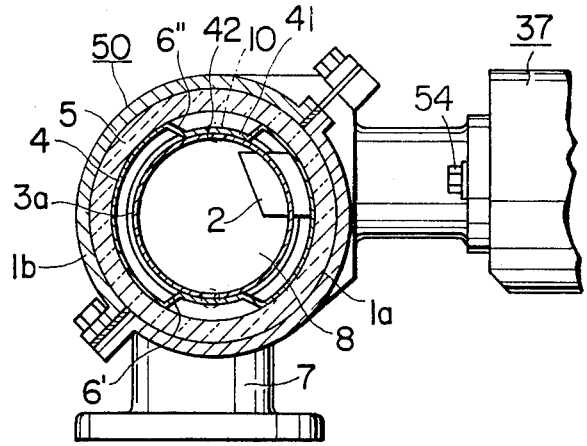
FIG. 4 is a transverse cross-sectional view similar to that shown in FIGS. 2 and 3, of still another embodiment of the manifold reactor according to the present invention.

FIG. 4 shows still another embodiment of the manifold reactor 50 according to the present invention, which is similar to that shown in FIG. 3, except that the band form of the other of the inner-core supporting members 6, as embodied in FIG. 2, is also replaced by a contour of a portion of the wall of the outer core 4. As embodied in FIG. 4, box-shaped portions 6', 6'' are formed at opposed locations in the wall of the outer core 4, each box-shaped portion having a bottom 41 in contact with the outer surface of the inner core 3 and secured thereto by a plug-weld through an aperture 42. The embodiment of FIG. 4, thereby eliminates the use of the band form of the innercore supporting members 6. This strengthens the construction of the manifold reactor 50 to a further extent, as compared with the embodiment of FIG. 3.

As is apparent from the foregoing description of the manifold reactor according to the present invention, the inner core may be split into at least two cylindrical parts so that loads shared by each inner-core supporting member may be lessened, and the supporting members for each of the parts of the inner core are not subject to the effect of thermal expansion of the other cylindrical part of the inner core, due to the sliding connection of the two cylindrical parts. In addition, the inner volume of the re-combustion chamber may be enlarged with ease, so that the dwelling time of the streams of exhaust gases within the manifold reactor may be extended, with improved converting efficiency for the exhaust gases.

Figure 5:
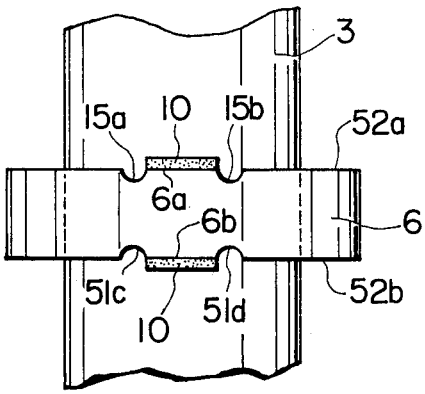
FIGS. 5, 6, and 7 are plane views of inner-core supports or supporting members having cuts adapted to avoid stress concentration.
Figure 6:
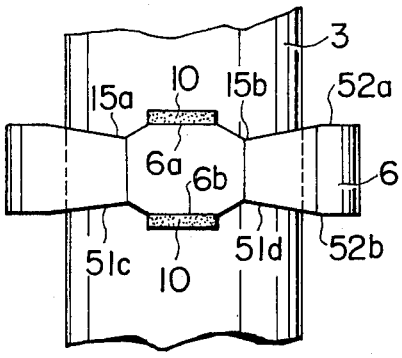
Figure 7:
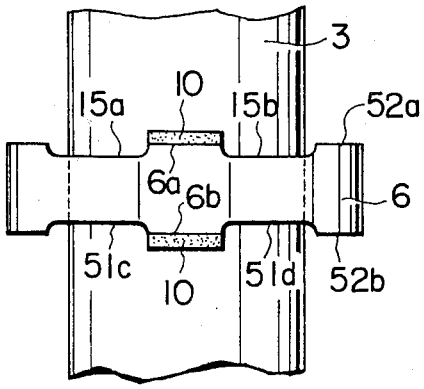

Turning now to FIGS. 5 to 7, in accordance with the invention, there are shown embodiments of the inner-core supporting member 6 in the band form. As shown therein, the inner-core supporting member 6 is provided with cut-out areas 51*a,* 51*b,* 51*c,* 51*d* on its longitudinal sides 6*a,* 6*b.* The cut-out areas 51*a,* 51*b,* 51*c,* 51*d,* as shown in FIG. 5, are arcuate with a given radius of curvature and positioned adjacent to the opposite ends of weld beads 10 interconnecting the inner-core supporting member 6 and the inner core 3. In other words, one weld bead 10 on the side 52*a* is defined by the cuts 51*a* and 51*b,* while the weld bead 10 on the other side 52*b* is defined by the cut-out areas 51*c* and 51*d.*

It should be noted, however, that the inner surfaces of the cut-out areas 51*a* to 51*d* are free from sharp corners, thereby avoiding the development of stress concentration at these positions. According to the prior art, there tends to take place cracking in the positions on the inner-core supporting member, which correspond to the positions of the cut-out areas 51*a* to 51*d,* due to thermal stresses created at the time of welding or by the repeated cycle of heating and cooling of the manifold reactor in service. The cracking thus produced will then be the source of stress concentration. As has been described earlier, the weld beads 10 are provided according to a fillet-welding technique, while the end or leg portions of the inner-core supporting member 6 are plug-welded to the inner surface of the peripheral wall of the outer core 4.

FIGS. 6 and 7 show further embodiments of the inner-core supporting member having other types of cut-out areas which are also free of sharp corners. The cut-out areas shown in FIG. 6 give further smooth contours, while such areas shown in FIG. 7 give yet further smooth contours, thereby dispersing the stresses to be concentrated on such positions.

While the present invention has been described herein with reference to certain exemplary embodiments thereof, it should be understood that various changes, modifications, and alterations may be effected without departing from the spirit and scope of the present invention, as defined in the appended claims.

What is claimed is:

1. In a manifold reactor for an internal combustion engine, the reactor including an inner core and an outer core of an elongated cylindrical form, said inner core being concentrically placed within said outer core in spaced relation from the walls of said outer core both in the radial direction and in the axial direction and having open, opposite ends; exhaust gas intake pipes extending from engine cylinders through the walls of said outer and inner cores so as to open within said inner core; and at least one exhaust-gas discharge pipe, having one end open to an annular space defined between the wall of said outer core and the wall of said inner core; the improvements comprising:

at least two axially aligned cylindrical parts constituting said inner core, said parts having overlapping contiguous ends forming sliding air-tight connection between adjoining parts; and supporting members symmetrically spaced about said cylindrical parts of said inner core for independently securing each of said cylindrical parts of said inner core to the inner surface of said outer core.

2. The improvements in the manifold reactor of claim 1, wherein said supporting members are arranged in pairs, the supporting members of said pairs being on opposite sides of the individual cylindrical part.

3. The improvements in the manifold reactor of claim 1, wherein said inner-core supporting member has a central portion and end portions, said central and end portions being bent to the contours of said inner core and said outer core, said central portion being fillet-welded to the outer surface of said inner core and said end portions being plug-welded to the inner surface of the wall of said outer core.

4. The improvements in the manifold reactor of claim 1, wherein at least one of said supporting members is formed by a projection in the wall of said outer core, said projection having a rectangular longitudinal cross section, and one side of said projection being in contact with the outer surface of said inner core and having an aperture therein for plug-welding said projection to said inner core.

5. The improvements in the manifold reactor of claim 1, wherein one of said overlapping contiguous ends of said cylindrical parts of said inner core has an increased diameter, said overlapping end of increased diameter slidingly fitted on an end of adjoining cylindrical part of said inner core in air-tight relation for avoiding the transfer of stress of thermal expansion of one cylindrical part of said inner core to an innercore supporting member of another cylindrical part.

6. The improvements in the manifold reactor of claim 3, wherein said inner-core supporting member is of a band form and includes cut-out portions of smooth contour in its longitudinal side edges, said cuts being located adjacent to the opposite ends of each fillet-weld bead interconnecting said inner-core supporting member and said inner core.

7. The improvements in the manifold reactor of claim 6, wherein said cut-out areas are arcuate in contour and have a radius of curvature free of sharp corners.

8. The improvements in the manifold reactor of claim 6, wherein said cut-out areas have smooth contours extending outwardly from said opposite ends of said fillet-weld bead toward said end portions of said inner-core supporting member.

* * * * *